US007645352B2

(12) United States Patent
Wambaugh et al.

(10) Patent No.: US 7,645,352 B2
(45) Date of Patent: Jan. 12, 2010

(54) BOX DISPENSER

(76) Inventors: Douglass Wambaugh, 1100 NW. Knoxville Ct., Bend, OR (US) 97702; Timothy Smythe, P.O. Box 5937, Bend, OR (US) 97708; Michael Lorenzen, 1010 NW. Roanoke Ave., #12, Bend, OR (US) 97701

( * ) Notice: Subject to any disclaimer, the term of this patent is extended or adjusted under 35 U.S.C. 154(b) by 598 days.

(21) Appl. No.: 11/273,602

(22) Filed: Nov. 14, 2005

(65) Prior Publication Data

US 2006/0180700 A1 Aug. 17, 2006

Related U.S. Application Data

(60) Provisional application No. 60/629,022, filed on Nov. 18, 2004.

(51) Int. Cl.

| | |
|---|---|
| ***B44C 7/02*** | (2006.01) |
| ***B29C 65/00*** | (2006.01) |
| ***B32B 37/00*** | (2006.01) |
| ***B65D 85/02*** | (2006.01) |
| ***B25H 3/02*** | (2006.01) |

(52) U.S. Cl. ..... 156/71; 156/574; 156/577; 156/579; 206/409; 222/180; 81/487

(58) Field of Classification Search ..... 156/71, 156/573, 574, 577, 578, 579; 206/389, 409, 206/411, 820; 221/70–74, 197, 198, 282–286; 222/175, 180; 81/487; 248/309.1, 310, 311.2
See application file for complete search history.

(56) References Cited

U.S. PATENT DOCUMENTS

| | | | | |
|---|---|---|---|---|
| 3,513,809 | A * | 5/1970 | Abbott et al. | 118/415 |
| 3,893,725 | A * | 7/1975 | Coulter et al. | 292/258 |
| 4,967,929 | A * | 11/1990 | Turner | 221/70 |
| 6,668,897 | B2 * | 12/2003 | Gunn | 156/577 |

FOREIGN PATENT DOCUMENTS

FR 2825992 A1 * 12/2002

OTHER PUBLICATIONS

English Abstract of FR 2,825,992.*

* cited by examiner

*Primary Examiner*—Philip C Tucker
*Assistant Examiner*—Sing P Chan
(74) *Attorney, Agent, or Firm*—Clifford Kraft

(57) ABSTRACT

A drywall tape or corner material dispenser that allows dispensing of the material directly from the box it is supplied in. The invention can contain a pair of parallel arms that grip the box and a strap that runs between the ends of the straps to close around the box. The strap can be fabric or other material and can be attached using hook/loop material like VELCRO. A handle on the other end of the arms can be used to grip the device and feed the material. The handle can have spring members top and bottom to further grip the box.

2 Claims, 1 Drawing Sheet

BOX DISPENSER

This application is related to and claims priority from U.S. Provisional Patent Application No. 60/629,022 filed Nov. 18, 2004. Application 60/629,022 is hereby incorporated by reference.

BACKGROUND

1. Field of the Invention

The present invention relates generally to the field of drywall installation and more particularly to a box dispenser that can dispense drywall tape or corner material directly from the box.

2. Description of the Prior Art

Previous systems have required drywall installers to remove a roll of tape or corner material from the box it comes in. Typically the drywaller takes the roll from the box and lays it on the floor. Every vertical or horizontal corner is then measured. Next the drywaller measures the correct length of taping or corner material while it is still on the floor. Finally the drywaller cuts the material to length and installs it in each corner.

SUMMARY OF THE INVENTION

The present invention relates to a drywall tape or corner material dispensing tool that can include a handle, a pair of parallel extended arms coupled to the handle at one end and coupled to a strap at another end, where the arms and strap are adapted to hold a drywall tape box and where the strap closes around the box to hold the box securely between the arms, handle and the strap, and where a portion the strap contains a section of hook or loop material with a mating portion of hook or loop material attached to one of the arms so that the strap can be closed around the box, and tape can be dispensed directly from the box.

Figure 2:
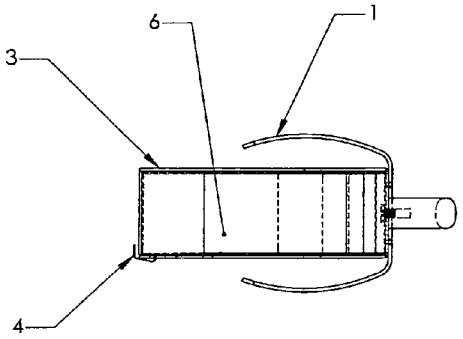
FIG. 2 shows a top view of the embodiment of FIG. 1.

Several drawings and illustrations have been provided in order to aid in the understanding of the present invention. The scope of the present invention is not limited to what is shown in the drawings.

DESCRIPTION OF THE INVENTION

The present invention relates to a box dispenser that can grasp a box of drywall tape or corner material and dispense the material directly out of the box without the necessity of the drywaller having to remove the roll of material from the box.

Figure 1:
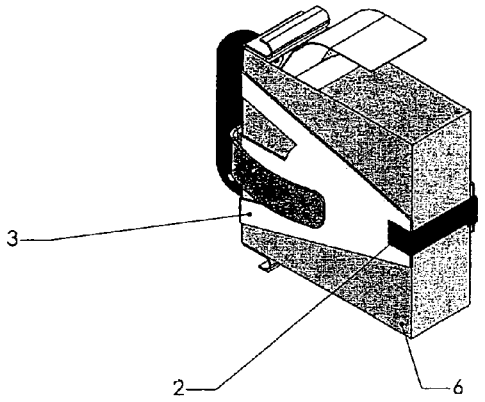
FIG. 1 shows a perspective view of an embodiment of the invention engaging a box of tape.

FIG. 1 shows a perspective view of an embodiment of the present invention grasping a box containing a roll of drywall material. The box holder 3 captures the box 6 by using a pair of optional spring members top and bottom. A pair of extended arms 7 extend outward along the side of the box 6. A strap 2 can be attached or removed from the arms to wrap around the rest of the box. The strap can be fabric and only have a portion of hook and loop material like that sold under the registered trademark VELCRO. The entire strap can be VELCRO, or there can be end portions of VELCRO for attachment. The configuration shown in FIG. 3 is a system that is loaded and ready to install paper tape or corner material directly into corners.

FIG. 2 shows a top view of the embodiment of FIG. 1. A double-sided handle 1 can be used to hold the device and also as a clip to attach the device to a worker's belt. The strap 2, with the VELCRO or other means of attaching can be used to keep the box 6 securely located and snug in the holder 3 and can be attached to an elongated pair of arms 7. The arms 7 and strap 2 grip the box 6. The strap 2 can be held in tight by a mating piece of loop or hook material 5. While the use of VELCRO is the preferred method, any attachment method can be used including a clip or lock for the strap.

Figure 3:
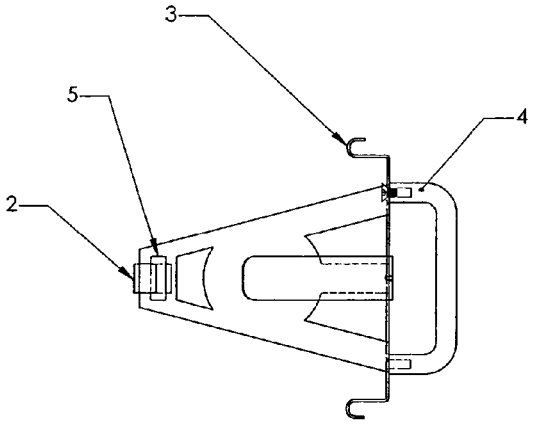
FIG. 3 shows a side view of the embodiment of FIG. 1.

FIG. 3 shows a side view of the embodiment of FIGS. 1 and 2. The box and taping material is not shown in this figure. The box holder 3 has bends that are mirrored so that the device becomes universal for both right and left handed users. A main handle 4 can be screwed onto the box holder 3 on one side. The strap 2 can be easily attached or unattached for quick and easy replacement of an empty box of material (new roll).

The handle and arms can be made from metal, plastic or other rigid or semi-rigid material, and the strap can be made from fabric or webbing or any other type of strap material.

Several descriptions and illustrations have been presented to better aid in understanding the present invention. One skilled in the art will realize that many changes and variations are possible without departing from the spirit of the invention. Each of these changes and variations is within the scope of the present invention.

We claim:

1. A method for dispensing drywall tape or corner material directly from a box, the method comprising the steps of:

cutting a slit in said box of drywall corner material and feeding said corner material from a roll in the box out of the slit without moving said roll;

placing the box in a dispenser device containing a handle coupled to a pair of extended parallel arms that run along opposite sides of said box gripping said box, said dispenser device also containing a top and bottom spring member capturing said box top and bottom at one end;

attaching a hook and loon material strap that is coupled to a distal end of one of said arms around the end of said box to a point on the other of said arms;

dispensing drywall corner material from said device holding said box directly onto drywall seams or corners.

2. The method of claim 1 wherein said arms and handle are metal.

* * * * *

UNITED STATES PATENT AND TRADEMARK OFFICE

CERTIFICATE OF CORRECTION

PATENT NO. : 7,645,352 B2
APPLICATION NO. : 11/273602
DATED : January 12, 2010
INVENTOR(S) : Douglass Wambaugh and Timothy Smythe It is certified that error appears in the above-identified patent and that said Letters Patent is hereby corrected as shown below:

Claim 1, at Col. 2, line 50 should read:

attaching a hook and loop material strap ...

instead of:

attaching a hook and loon material strap ...

Signed and Sealed this

Twenty-fifth Day of May, 2010

David J. Kappos

David J. Kappos
*Director of the United States Patent and Trademark Office*